US006921558B2

(12) United States Patent
Fredericksen et al.

(10) Patent No.: US 6,921,558 B2
(45) Date of Patent: Jul. 26, 2005

(54) METHOD FOR POWDER COATING PLASTIC ARTICLES AND ARTICLES MADE THEREBY

(75) Inventors: David E. Fredericksen, Palatine, IL (US); George M. Vollrath, Paxton, IL (US); Algis P. Suopys, Lindenhurst, IL (US); Guy L. Rosenthal, Wheaton, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/025,156

(22) Filed: Dec. 18, 2001

(65) Prior Publication Data

US 2003/0113476 A1 Jun. 19, 2003

(51) Int. Cl.[7] ..... B05D 3/02; B05D 1/04

(52) U.S. Cl. ..... 427/475; 427/485; 427/195; 427/316

(58) Field of Search ..... 427/470–486, 427/195, 202, 203, 316, 318

(56) References Cited

U.S. PATENT DOCUMENTS

| | | | | |
|---|---|---|---|---|
| 3,839,078 | A | | 10/1974 | Birchall et al. |
| 4,012,363 | A | | 3/1977 | Bruning et al. |
| 4,169,187 | A | | 9/1979 | Glazar |
| RE32,261 | E | | 10/1986 | Hirota et al. |
| 4,737,403 | A | | 4/1988 | Simpson et al. |
| 4,758,450 | A | | 7/1988 | Czech et al. |
| 4,794,027 | A | | 12/1988 | Hering |
| 5,021,297 | A | | 6/1991 | Rhue et al. |
| 5,110,633 | A | | 5/1992 | Cassat et al. |
| 5,338,578 | A | * | 8/1994 | Leach |
| 5,344,672 | A | * | 9/1994 | Smith |
| 5,470,609 | A | | 11/1995 | Leach et al. |
| 5,516,551 | A | * | 5/1996 | Anderson et al. |
| 5,552,487 | A | | 9/1996 | Clark et al. |
| 5,565,240 | A | | 10/1996 | Smith |
| 5,846,607 | A | | 12/1998 | Hurley et al. |
| 6,074,740 | A | | 6/2000 | Scheckenbach et al. |
| 6,124,563 | A | | 9/2000 | Witherspoon et al. |
| 6,203,913 | B1 | | 3/2001 | Kondos et al. |

FOREIGN PATENT DOCUMENTS

| | | |
|---|---|---|
| WO | 99/54108 | * 10/1999 |

* cited by examiner

*Primary Examiner*—Fred J. Parker
(74) *Attorney, Agent, or Firm*—Mark W. Croll, Esq.; Paul F. Donovan, Esq.; Welsh & Katz, Ltd.

(57) ABSTRACT

A method for powder coating articles includes the steps of preheating the article to a preheating temperature, coating the article with a polymeric powder coating having a cross-linking temperature that is above the preheating temperature and curing the article having the powder coating applied thereto at a curing temperature. The curing temperature is between the powder coating cross-linking temperature and the melting point temperature of the articles. A system for carrying out the coating method is disclosed as is an article made by the method.

14 Claims, 1 Drawing Sheet

METHOD FOR POWDER COATING PLASTIC ARTICLES AND ARTICLES MADE THEREBY

BACKGROUND OF THE INVENTION

The present invention pertains to a method for powder coating plastic parts or articles and parts or articles made by the method. More particularly, the present invention pertains to a method for powder coating plastic, non-conductive articles using resin-type coating materials, without the need for electrically grounding the articles, and articles made by this method.

Myriad articles are coated in order to protect the articles and to provide an aesthetically appealing appearance. For example, many automobile parts are coated, e.g., chromed, to provide a desired aesthetic effect. Often, metal parts are chrome plated using well-known, liquid chrome-plating techniques. However, one drawback to this plating method is that undesirable chemical compounds are a byproduct of the process. These compounds must be contained and treated to avoid environmental concerns.

In another known coating method, a metal part is grounded and a coating is applied to the part, as a powder, through an electrostatic spray device, e.g., gun. The powdered coating is attracted to the part by the opposite charges of the coating particles and the article to be coated. In such a process, it is necessary to maintain the articles grounded in order to effect the electrostatic attraction between the coating particles and the article.

It is also known to coat articles with liquid paint. For example, a paint may be applied to any type of article (metallic or non-metallic) by known methods. In such painting techniques, the paints are carried in a vehicle that typically contains high levels of volatile organic compounds (VOCs). In the painting and curing stages, these VOCs are emitted into the work environment and possibly into the atmosphere. As will be appreciated, VOCs are environmentally undesirable, often ozone depleting compounds. As such, the emission of VOCs is an undesired side effect of conventional painting techniques.

In that plastic parts typically cannot be electrically grounded, one known method for powder coating plastics requires that the plastic article be coated with a conductive material prior to the application of the powder. That is, it has been found that in order to properly coat the plastic parts, it is necessary to pre-treat the parts with, for example, a solution of a salt and isopropyl alcohol. Upon drying of the alcohol, the salt remains on the surface of the plastic article and thus provides the necessary conductivity to electrically ground the article. This, however, has been found to be an expensive, time consuming and inefficient method for coating such plastic articles.

It has also been found that some of the known techniques for applying a coating (e.g., painting or powder coating) to plastic articles do not provide an acceptable quality level of the coating on the part. One known criteria is the visual smoothness of part coating, referred to as an orange peel rating. On a relative scale, glass has a 10 rating and an orange peel has a 1 rating. An acceptable level for coated part smoothness for certain industries is a rating of 7 or greater. Various automobile manufacturers have internal quality procedures and standards for determining orange peel ratings.

Accordingly, there exists a need for a method for powder coating plastic parts or articles. Desirably, such a method is an efficient and cost-effective method for coating plastic articles using resin-type powder coating materials. More desirably, such a method can be used with non-conductive plastic articles. Most desirably, such a method reduces the overall emission of VOCs while providing a high quality, protective and aesthetically appealing powder coating on such articles. Further still, a desirable method provides powder coated articles having an acceptable cosmetic or aesthetic appearance with increased resistance to environmental conditions.

BRIEF SUMMARY OF THE INVENTION

A method for powder coating a part or article is used with a non-conductive article and does not require electrically grounding the article. The method includes preheating the article to a preheating temperature below a melting point temperature of the article and coating the article with a polymeric powder coating. The polymeric powder coating has a cross-linking temperature that is above the preheating temperature.

The article, having the powder coating applied thereto, is cured at a curing temperature. The curing temperature is between the powder coating cross-linking temperature and the melting point temperature of the article; that is, the curing temperature is above the powder coating cross-linking temperature and below the melting point temperature of the article.

A present method includes the step of drying the article at a temperature below a melting point temperature of the article prior to preheating the article. The method can include cleaning the article to remove contamination with a wash solution prior to preheating the article and drying the article to remove any remaining wash solution.

The cured, coated article can be cooled subsequent to curing, to an appropriate handling temperature.

In a present method, the step of applying a second coat of polymeric powder coating on the article is carried out. The second coat of polymeric powder coating has a cross-linking temperature and is applied over the first coating of the powder coating after curing the first coating.

The second coat of polymeric coating is applied over the first coat of powder coating at a temperature below the cross-linking temperature of the second coat of polymeric powder coating. Preferably, a preheating step is carried out for the second coating material to assure that the article is a desired temperature prior to applying the second coating material.

After applying the second coating material, the article is cured at a curing temperature that is between the cross-linking temperature of the second coat of powder coating and the melting point temperature of the article. In this optional method, the first drying step, the cleaning step and the second drying step can likewise be carried out.

The coating step can include spraying the powder coating material from an electrically charged device, preferably, an electrostatic spray gun. The method can be carried out in connection with non-grounded articles.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
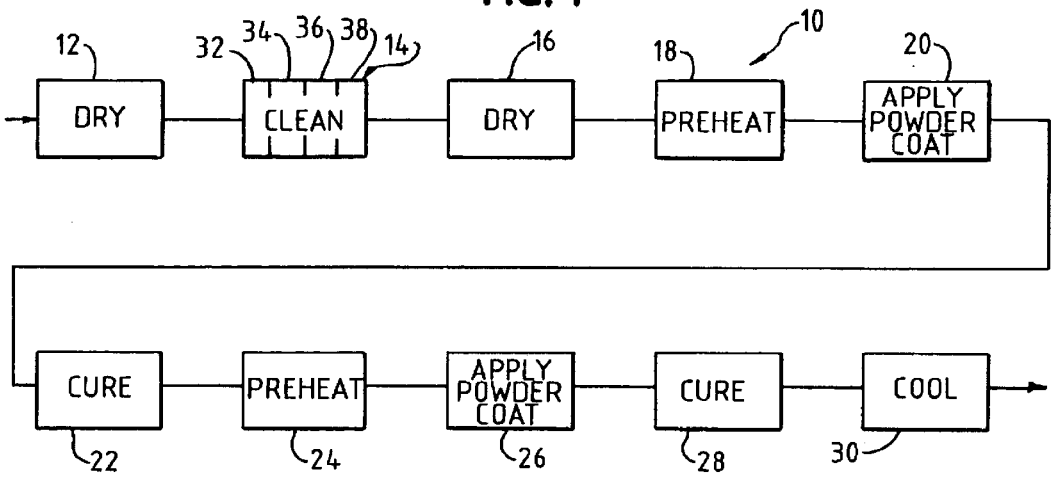
FIG. 1 is a flow diagram of an exemplary method for powder coating plastic articles embodying the principles of the present invention.

While the present invention is susceptible of embodiment in various forms, there is shown in the drawings and will hereinafter be described presently preferred methods and embodiments with the understanding that the present disclosure is to be considered an exemplification of the invention and is not intended to limit the invention to the specific methods described and embodiments illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring now to the figures and in particular to FIG. 1, a flow diagram of a method, indicated at 10, for powder coating plastic articles is shown, which method 10 embodies the principles of the present invention. As provided in FIG. 1, the method 10 can include the steps of drying the article (indicated at 12) at a temperature below a melting point temperature of the article and cleaning the article (indicated at 14) with a wash solution to remove any surface contamination. The article is then dried (indicated at 16) again to remove any remaining wash solution.

The method 10 includes the step of preheating the article (indicated at 18) to a preheating temperature. The article is then coated (indicated at 20) with a polymeric powder coating, the polymeric powder coating having a cross-linking temperature that is above the preheating temperature. Subsequent to applying the powder coating material, the article is cured (indicated at 22), with the powder coating thereon, at a curing temperature that is between the powder coating cross-linking temperature and the melting point temperature of the article (i.e., above the cross-linking temperature and below the melting point). The article is then cooled (indicated at 30) for subsequent handling.

Optionally, the coated and cured article can have a second or top coat applied over the first coat. In applying this optional top coat, the article is preheated (indicated at 24) to a second preheating temperature less than a cross-linking temperature of the second powder coating material. The top coat powder coating material is then applied to the article (indicated at 26). The article is cured (indicated at 28) and then cooled (indicated at 30) to an appropriate temperature for handling.

As will be recognized by those skilled in the art, prior to the present method, it was difficult to powder coat articles, particularly non-conductive articles, with resin-type coatings. As such, prior known coating methods focused on spraying liquid paints and related technologies to coat, for example, plastic parts or articles. As will also be recognized by those skilled in the art, many such liquid paints are carried by vehicles that contain high levels of VOCs. During the paint curing and drying process, the VOCs are driven off or evaporated, leaving the "paint" on the article. The evaporated organic vehicle is emitted into the work environment and possibly into the environs. While such techniques have provided effective coating methods and acceptably coated articles, the emission of VOCs is a highly undesirable side effect. As such, VOC reduction would be an "environmentally-friendly" approach to provide high quality coated articles.

It will also be recognized by those skilled in art, that coating articles is a desirable, if not, necessary process for many uses. For example, in the automotive industry, it is important, if not necessary, to coat many articles to protect the articles from, for example, environmental conditions, such as salt, water, dirt, oils, ultraviolet effects and the like, and to reduce the susceptibility of the part or article to abrasion. It is also necessary to provide these articles with a desired aesthetic appearance.

In that plastics are considerably lighter in weight than many metals, the use of plastics in automobile manufacturing has increased. Many types of plastics are widely used in non-structural applications. In addition, other types of plastics have sufficient structural strength for use in structural applications. Thus, it follows that such plastic articles must be coated in order to provide a protective coating having a desired aesthetic effect or "look".

In a preferred process, the first drying step 12 is carried out at a temperature that is below a melting point temperature of the article, but is sufficiently high to drive any water out of the article. It has been found that in many plastic parts, water can be trapped within the plastic material. One known plastic material that is often used in automobile parts is MINLON® T3M40 Type 6 Nylon, commercially available from E.I. DuPont de Nemours and Company of Wilmington, Del.

This material, which is exemplary of the plastic materials used in automobile manufacture, is a nylon resin reinforced with a mineral fill of about 10 percent to about 50 percent and typically about 40 percent. It has been found that this material can hold or trap water within the body of the material. As such, the first drying step 12 is carried out to remove or eliminate this trapped water to the greatest extent possible. A preferred first drying step 12 is carried out at about 400° F. for about 30 minutes. It has been found that heating at this temperature for this period of time removes the moisture that may be trapped within the material. Such a drying step can be carried out using a conventional convection-heating step, such as forced air with natural gas heating.

It will be recognized by those skilled in the art that the first drying step is used to reduce the amount of, if not eliminate the "trapped" moisture in the article. Otherwise, during the curing step (as will be described below), the water trapped in the article could be driven from the article after it has been coated. This could result in bubbles forming or "blistering" of the coating as water (or water vapor) is driven from the article. It will also be recognized by those skilled the art that when the articles are manufactured and stored in environments with sufficiently low humidity levels, this first drying step, although suggested, may not be necessary.

The article is then cleaned 14 to remove any surface contamination that may be on the article. This cleaning step is carried out using a wash solution, preferably an aqueous wash solution. In a current cleaning step 14, four stages 32, 34, 36 and 38 are used to provide acceptable cleanliness levels. In a first wash stage 32, an acid etch soap solution is applied to the article. One known solution is POLYPREP® Cleaner 2595 available from Henkel KGaA of Dusseldorf, Germany. The acid etch soap solution is applied with a preheat water spray at a temperature of about 110° F. to 160° F. A second wash stage 34 is a water rinse using city water at ambient temperature, again through a nozzle spray.

A third wash stage 36 uses a water spray, preferably using processed water, preferably at room temperature. The third wash stage 36 can include a chemical rinse aid to remove any residual matter. Processed water can be provided by treating the water through a reverse osmosis process or the like.

The fourth and final wash stage 38 of the cleaning step 14 again uses processed water, e.g., reverse osmosis, deionization, demineralization, ion exchange, softening and the like. All such processing methods are within the scope and spirit of the present invention. After the cleaning step is complete, the articles are again dried to remove any remaining wash solution.

The articles are then preheated 18 to a preheating temperature. As set forth above, the preheating temperature must be below the melting point temperature of the articles, and is also below a cross-linking temperature of the powder coating material applied to the article. In a present process, the articles are preheated to a temperature of about 220° F.–250° F. As will be described in more detail below, this is below the cross-linking temperature of one preferred coating material (which is about 325° F.). Those skilled in the art will recognize that other powder coating materials may be used, which other materials may have different cross-linking temperatures. As such, the specific temperatures provided herein are exemplary specific materials identified and used in the illustrative process. In a preferred preheating step, the articles are heated using infrared heating techniques to provide precise control over the heating temperatures.

Following the preheating step 18, the powder coating material is applied 20 to the articles. In a present process, the coating material is a thermosetting, TGIC carboxyl polyester resin commercially available under part number VP-400164 from Ferro Corporation of Cleveland, Ohio. The coating material can include flow modifiers, fillers, metallic particles and the like. In a present system, the coating is applied using an electrostatic powder coating gun commercially available from ITW Gema, and is applied in an environmentally controlled cubicle or booth. The booth is equipped with a ventilation system providing cross-ventilation with air movement at a rate of about 20–100 cubic feet per minute.

Without being bound by theory, although an electrostatic attraction principle is not the basis for the retention of the sprayed particles on the article (e.g., as it is with electrically conductive and ground articles), it has been found that using an electrostatic spray apparatus "aligns" the powder coating material as is exits the spray gun. This is, of course, due to the electrostatic fields generated by the firing gun. It has also been found that the charged coating material, when "aligned" by passing through the gun provides a more even or consistent coating on the article.

It has been found that preheating the article to a temperature above ambient temperature, but below the cross-linking temperature of the powder coating material results in the powder coating material becoming somewhat "sticky" or adherent, thus providing the necessary retention of powder coating material on the article. This corresponds to the "softening" temperature of the powder coating material.

Advantageously, it has also been found that preheating the article to a temperature above ambient temperature, but below the cross-linking temperature of the powder coating material permits reuse of any material that does not adhere to the article. Thus, the material that falls from the article can be reused in that it has not been subjected to its cross-linking temperature and cross-linking of the material has not yet begun to occur.

Subsequent to applying the powder coating material 20, the coated articles are cured 22. In a preferred method, the articles are cured at a temperature below the melting point of the article, and above the cross-linking temperature of the powder coating material. In a present process, the plastic has a melting point temperature of about 425° F. and the cross-linking temperature of the carboxyl polyester resin coating material is about 325° F.; thus, the cure step is carried out at temperature between 325° F. and 425° F., and preferably at a temperature of about 400° F. The cure step is carried out by first using infrared heating for a period of about 1 minute to achieve a surface temperature of at least the cross-linking temperature (about 375° F. to about 425° F.), followed by conventional convection heating at about 375° F. to about 425° F. for about 4 minutes. Alternately, cure can be carried out by using only conventional, convection-type heating at about 375° F. for about 15 minutes.

Subsequent to the cure step 22, the article is cooled 30 to an appropriate handling temperature.

Optionally, a second or subsequent coating can be applied to the part. In such an optional over-coating process, after cure of the base coat, and before cooling, the article is once again preheated. Preheating 24 is carried out at a temperature below the melting point temperature of the articles, and also at a temperature below a cross-linking temperature of the second coating material. In a present process, in which a preferred second coating material has a cross-linking temperature of about 325° F., the articles are preheated to a temperature of about 220° F.–250° F. Preferably, preheating is carried out using infrared heating techniques to provide precise control over the heating temperatures.

After the second preheating step 24, the second coating step 26 is carried out. Such a coating step 26 can be carried out using a "clear-coat" material, such as a thermosetting, TGIC carboxyl polyester resin coating material also commercially available from Ferro Corporation under part number VP-1125. The coating material can include flow modifiers, fillers, metallic particles and the like. The top-coat material should be compatible with the base coat material.

Where the optional second coating step 26 is carried out, the part is re-cured 28 after application of the clear-coat material, again preferably at about 400° F. using infrared heating for a period of 1 minute to achieve a surface temperature of at least the cross-linking temperature (about 375° F. to about 425° F.), followed by conventional convection heating at about 375° F. to about 425° F. for about 4 minutes. Alternately, the second cure step 28 can be carried out by using only conventional, convection-type heating at about 375° F. for about 15 minutes. Subsequent to the second curing step 28, the part is cooled 30 to an appropriate handling temperature.

As will be recognized by those skilled in the art, the present method provides for a high quality, powder coated article without the use of liquid spray painting and like organic carrier techniques. Such parts have exhibited desirable orange peel characteristics. For example, it has been found that parts coated to a thickness of about 10–12 mils (10–12 thousandths of an inch) using the above process have an orange peel rating of about 8. Thus, these parts have been found to be acceptable in accordance with generally accepted automotive manufacturer specifications.

Those skilled in the art will also recognize that while specific materials have been set forth above, other suitable materials can be used in their stead, which other suitable materials are within the scope and spirit of the present invention.

Figure 2:
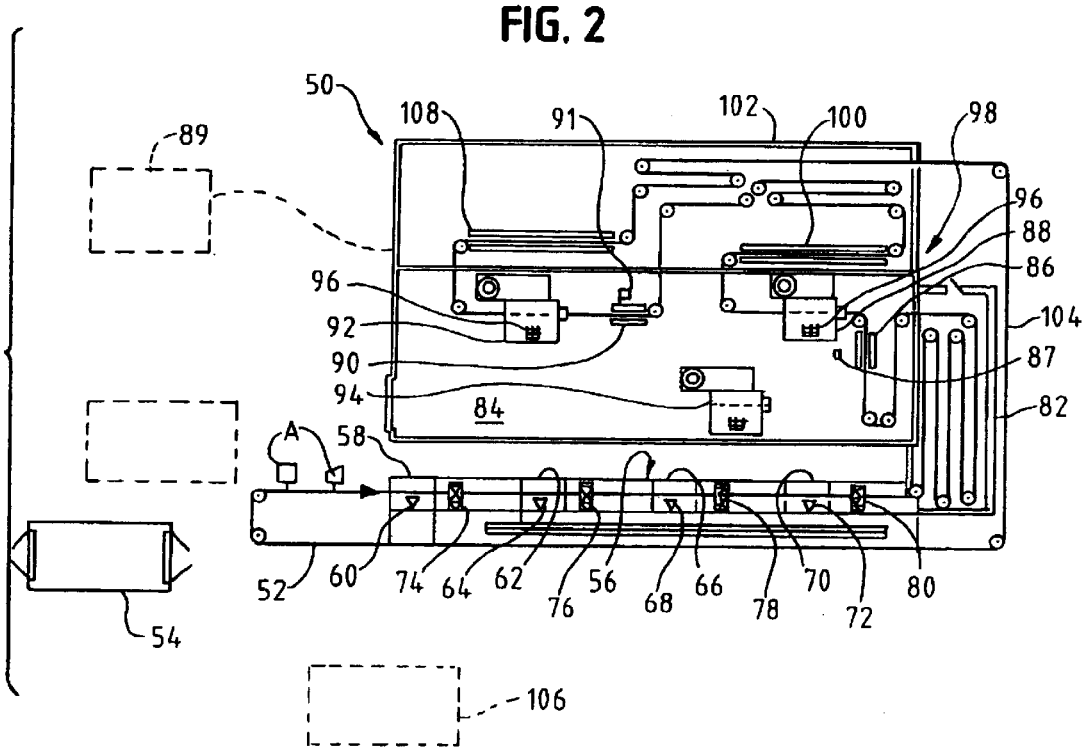
FIG. 2 is a schematic illustration of one embodiment of a powder coating system embodying the principles of the present invention.

Referring now to FIG. 2, there is shown an exemplary powder coating system 50 for carrying out the powder coating method 10 of the present invention. The system 50 includes a conveying apparatus 52, such as a conveyor chain to move the articles A through the various stations. A first station 54 is a batch oven for carrying out the first drying step, if necessary. The batch oven 54 can be a conventional convection-heating oven, such as a natural gas fired, forced air system. Other types of drying systems can of course be used, which other types of drying systems are within the scope and spirit of the present invention. In that the time for carrying out the first drying step 12 is considerably longer than the times required for the other steps in the process, it is anticipated that the batch oven 54 will be a batch-type operation, carried out "off-line" from the other stations within the system 50.

From the batch oven 54 (again, if necessary), the articles A are loaded onto the conveying apparatus 52 and are indexed to the cleaning station 56. The cleaning station 56 includes a first wash substation 58 having a spray area 60, a second wash substation 62 having a spray area 64, a third wash substation 66 having a spray area 68, and a fourth wash substation 70 having a spray area 72. Each of the substations 58, 62, 66 and 70 can include a blower or air moving device 74, 76, 78 and 80 to remove excess solution from the articles A. Alternately, blowers can be located at alternating substations or at an end of the cleaning station 56.

Following the cleaning station 56, the conveyor 52 moves the articles A to a dry-off oven 82. The oven 82 dries any remaining wash solution from the articles A. A present dry-off oven 82 uses conventional convection-heating to remove the residual wash solution from the articles A.

The articles A are then conveyed into an environmentally controlled area 84. The environmentally controlled area 84 includes a base coat preheater 86 and a base coat spray room 88, and optionally, a top-coat preheater 90 and a top-coat spray room 92. An additional "off-line" spray room 94 can be included within the environmentally controlled area 84 to provide redundant coating operation capability. The base coat preheater 86 is preferably of the infrared heating type to permit precise control of the temperature to which the articles A are preheated. To regulate the preheat exit temperature of the articles A (to be coated), optical pyrometers 87 will read (in a non-contacting manner) the article A temperature and transmit the value to a programmable logic control (PLC) 89, and adjust the infrared element intensity with preset, alarmed limits, thus maintaining a close-looped temperature control. Following the base coat preheat step 18, the articles A are conveyed into the base coat spray room 88. As set forth above, an electrostatic spray gun 96 is used to apply the powder coating material to the articles A as they move through the room 88. The articles A then exit the room 88 and are conveyed into a curing oven 98.

The curing oven 98 includes heaters 100, preferably infrared heaters (again, for precise control of the curing temperature). The articles A are then conveyed through a convection oven 102 to complete the curing cycle 22. Following the curing cycle 22, the articles A exit the oven 102 and move through a cool down station 104. Once the articles A have reached an appropriate handling temperature, they are off-loaded from the system 50 at a packing area 106.

As provided above, the articles A can have a "top-coat" applied thereto over the base coat. As illustrated in FIG. 2, the present system 50 is configured for applying such a top-coat. In this operational mode, after the articles A exit the convection oven 102 (at the end of the base coat cure cycle 22), they are conveyed to the top-coat preheater 90. As with the base coat preheater 86, the top-coat preheater 90 is preferably an infrared-type heater to provide precise control of the preheat temperature. Again, to regulate the preheat exit temperature of the articles A (to be top-coated), optical pyrometers 91 will read (in a non-contacting manner) the article A temperature and transmit the value to the PLC 89, and adjust the infrared element intensity with preset, alarmed limits, thus maintaining a close-looped temperature control. From the top-coat preheater 90, the articles A are conveyed to the top-coat spray room 92 where an electrostatic spray gun 96 applies the top-coat powdered coating material.

Following application of the top-coat material, the articles A are cured by conveying the articles A through a heater 108 (preferably an infrared heater) and into a section of the convection oven 102 to complete the top-coat curing cycle 26. Following the curing cycle 26, the articles A exit the oven 102 and move through the cool down station 104. After reaching an appropriate handling temperature, the articles A are off-loaded at the packing area 106.

It has also been found that article shape or geometry can affect the consistency of the coating. That is, it has been observed that edges, corners and sharp bends are best oriented vertically when coated. This provides enhanced control over the consistency and quality of the coating, thus producing a desirable aesthetic and defect-free appearance.

Those skilled in the art will recognize that various alternate coating systems can be used, which systems may combine or separate out portions of the exemplary, illustrated system, or may substitute other types of process equipment for the process equipment described. It is intended that all such alternate system configurations and equipment are within the scope and spirit of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for powder coating a plastic injection molded article comprising the steps of:

preheating the article to a preheating temperature that is above a melting point temperature but below a curing temperature;

substantially completely degassing the article;

coating the preheated and degassed article with a polymeric powder coating, the polymeric powder coating having a cross-linking temperature that is above the preheating and melting point temperatures, the powder coating softening and adhering to the preheated and degassed article, the powder coating being sprayed from an electrically charged device; and heating the article having the powder coating applied thereto at the curing temperature, which is higher than the preheating temperature, the curing temperature being at least 375° F. and being between the powder coating cross-linking temperature and the melting point temperature of the article to produce a coated and cured degassed plastic injection molded article.

2. The method for powder coating in accordance with claim 1 including the step of drying the article at a temperature below a melting point temperature of the article prior to preheating the article.

3. The method for powder coating in accordance with claim 1 including the step of cleaning the article to remove contamination with a wash solution prior to preheating the article.

4. The method for powder coating in accordance with claim 3 including the step of drying the article to remove any remaining wash solution.

5. The method for powder coating in accordance with claim 1 including the step of cooling the coated article subsequent to curing the article.

6. The method for powder coating in accordance with claim 1 including the step of applying a second coat of polymeric powder coating on the coated and cured article, the second coat of polymeric powder coating having a cross-linking temperature and being applied over the first coating of the powder coating after curing thereof, the second coat of polymeric coating being applied over the first coat of powder coating at a temperature that is above the melting point temperature but below the cross-linking temperature of the second coat of polymeric powder coating and is above the preheating temperature; and heating the article having the second coat of powder coating applied thereto at a second curing temperature that is higher than the preheating and melting point temperatures, the second curing temperature being at least 375° F. and being between the cross-linking temperature of the second coat of powder coating and the melting point temperature of the article.

7. The method for powder coating in accordance with claim 6 including the step of cleaning the article at a temperature below a melting point temperature of the article prior to preheating the article.

8. The method for powder coating in accordance with claim 6 including the step of cleaning the article to remove contamination with a wash solution prior to preheating the article.

9. The method for powder coating in accordance with claim 8 including the step of drying the article to remove any remaining wash solution.

10. The method for powder coating in accordance with claim 6 including the step of cooling the coated article subsequent to curing the article.

11. The method for powder coating in accordance with claim 1 wherein the electrically charged device is an electrostatic spray gun.

12. The method for powder coating in accordance with claim 1 wherein the preheating temperature is about 220° F. to about 250° F. and the powder coating is a carboxyl polyester resin based material having a cress-linking temperature greater than about 250° F., and wherein the article is cured at a temperature of about 400° F.

13. The method for powder coating in accordance with claim 12 including the steps of: applying a second coat of polymeric powder coating on the article, the second coat of polymeric powder coating being a carboxyl polyester resin based material having a cross-linking temperature great than about 250° F., the second coat of resin being applied over the cured first coating and being applied at a temperature less than about 250° F.; and curing the article having the second coat of resin at a temperature of about 400° F.

14. The method for powder coating in accordance with claim 1 including the step of supporting the article without regard as to electrically grounding the article.

* * * * *

UNITED STATES PATENT AND TRADEMARK OFFICE

CERTIFICATE OF CORRECTION

PATENT NO. : 6,921,558 B2
DATED : July 26, 2005
INVENTOR(S) : Fredericksen et al.

It is certified that error appears in the above-identified patent and that said Letters Patent is hereby corrected as shown below:

Column 10,
Line 2, should be -- ...including the step of drying the article at a temperature below a melting point temperature... --.

Signed and Sealed this

Twenty-eighth Day of February, 2006

JON W. DUDAS
*Director of the United States Patent and Trademark Office*